United States Patent [19]

Yamamoto et al.

[11] 3,940,895

[45] Mar. 2, 1976

[54] EARTHQUAKE ISOLATING AND VIBRATION ABSORBING EQUIPMENT FOR STRUCTURES

[75] Inventors: Shizuo Yamamoto; Yuichi Nagai, both of Tokyo; Nobuyuki Shimizu, Yokohama; Hiroshi Tajimi, Tokyo, all of Japan

[73] Assignee: Chiyoda Chemical Engineering & Construction Co. Ltd., Yokohama, Japan

[22] Filed: Aug. 9, 1974

[21] Appl. No.: 496,216

[30] Foreign Application Priority Data

| | | |
|---|---|---|
| Aug. 10, 1973 | Japan | 48-89339 |
| July 13, 1974 | Japan | 49-79738 |
| July 11, 1974 | Japan | 49-78687 |
| July 13, 1974 | Japan | 49-82245[U] |
| July 13, 1974 | Japan | 49-82246[U] |

[52] U.S. Cl. ..... 52/167; 52/292

[51] Int. Cl.[2] ..... E04H 9/02

[58] Field of Search ..... 52/167, 573, 292; 248/358 R

[56] References Cited

UNITED STATES PATENTS 1,761,322 6/1930 Wells ..... 52/167

*Primary Examiner*—J. Karl Bell

*Attorney, Agent, or Firm*—Holman & Stern

[57] ABSTRACT

An earthquake isolating and vibration absorbing equipment for structures is provided with a hanger secured to one of a floor including a ground and a supported member of a structure installed on the floor, a lever, one end of which is swingably mounted on the hanger, a weight member mounted on the other end of the lever, a holder secured to the other one of the floor and supported member, and arms for connecting one end of the lever to the free end portion of the holder. The structure provided with the equipment is less influenced by an earthquake or vibrations under the action of the lever on which there is mounted the weight member having a weight far lighter than that of the structure.

16 Claims, 48 Drawing Figures

EARTHQUAKE ISOLATING AND VIBRATION ABSORBING EQUIPMENT FOR STRUCTURES

BACKGROUND OF THE INVENTION

This invention relates to a vibration absorbing mechanism for structures and more particularly to an earthquake isolating and vibration absorbing equipment for structures including buildings and spherical tanks.

Recently, there has been an increase in the number of structures, such as multistory buildings, spherical tanks for storing liquid gas and warehouses for the storage of dangerous articles. As a result, these structures are in constant danger of being destroyed by vibrations due to earthquakes, operation of machines installed in a factory, and so on with the attendant disaster.

PRIOR TECHNIQUES

It is known that, in an attempt to prevent a structure built on the group from being resonated due to such vibration or earthquake by shifting the natural period of the structure, there is provided an earthquake isolating and vibration absorbing equipment comprising a pendulum suspended from the structure or an inverted pendulum swingably mounted on or fixedly secured to the structure. However, it is necessary that, in order to attain the desired absorbing effect, the weight of a weight member of the pendulum be made 1/15 to ½ the weight of the structure. As a result, a great excess load is applied to the structure and, in addition, the equipment unavoidably occupies a greater space. This is particularly true where the equipment is installed in the building, the inner space of the building is narrowed, because of the bulkiness of the equipment, with the resultant disadvantage. When an attempt is made to mount the equipment on a tank structure through newly prepared girders, it is necessary to strengthen the tank structure, particularly by replacing the columns with a new rigid ones or the foundation with reinforced one, since the conventional tank structure or foundation has no rigidity sufficient to support the equipment. It is also necessary to provide a great space for installation of the equipment.

OBJECTS AND SUMMARY OF THE INVENTION

It is accordingly an object of this invention to provide an earthquake isolating and vibration absorbing equipment for structures, which prominently enhances a damping effect by decreasing the response acceleration of each part of the structure as caused by the vibration of a foundation of the structure and shifting the natural period of the structure.

Another object of this invention is to provide an earthquake isolating and vibration absorbing equipment for structures, which can be easily mounted on the structure with little or no modification thereby.

Another object of this invention is to provide a lightweight and small-sized earthquake isolating and vibration absorbing equipment for structures.

According to this invention, there is provided an earthquake isolating and vibration absorbing equipment for structures, comprising a hanger connected to one of a floor and a supported member of a structure installed on the floor, a lever one end portion of which is swingably mounted on the hanger, a weight member mounted on the other end of the lever, a holder connected to the other one of the floor and supported member, and arm means having one end pivoted to the free end portion of the holder and the other end pivoted to said one end portion of the lever other than a first pivotal point at which the lever is swingably mounted on the hanger.

Dependent upon the type of structures, the hanger may be secured to a saddle-type support adapted to be secured to either one of the floor or supported member.

A second pivotal point at which the lever is pivoted to the other end of the arm means may be located between the weight member and the first pivotal point, or the second pivotal point may be located remote from the weight member than the first pivotal point.

This invention will be described by way of example with reference to the accompanying drawings.

BRIEF DESCRIPTION OF THE DRAWINGS

Throught the figures, the same reference numerals are employed to designate similar or identical parts or elements. An earthquake isolating and vibration absorbing equipment according to this invention is hereinafter referred to merely as an absorbing equipment.

DETAILED DESCRIPTION OF THE EMBODIMENTs

Figure 1:
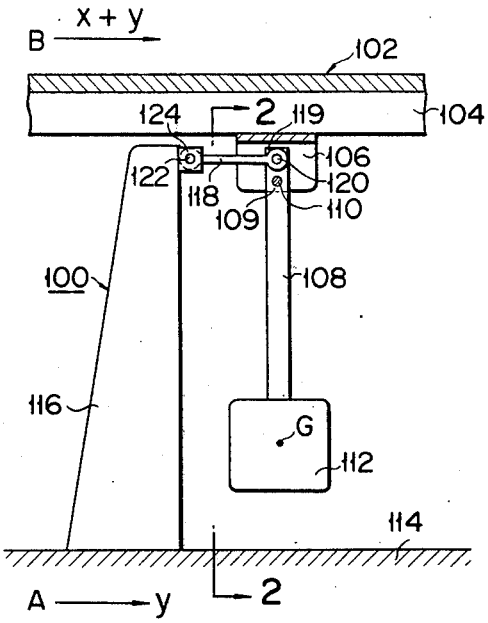
FIG. 1 is a front view, as taken along line 1—1 in FIG. 2, of an earthquake isolating and vibration absorbing equipment according to one embodiment of this invention.
Figure 2:
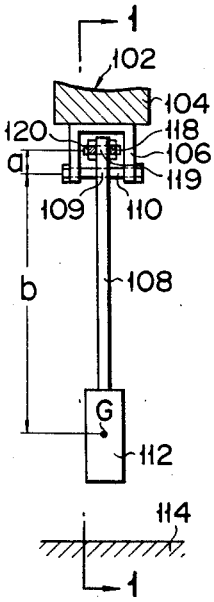
FIG. 2 is a view taken along line 2—2 in FIG. 1.

In FIGS. 1 and 2, the absorbing equipment is generally designated at 100. A hanger 106 is secured to a supported member 104 (for example, a ceiling and beam of a building, girder or spherical tank) of a structure 102 (including a multistoried structure, spherical tank etc.) whose vibration due to earthquake, operation of machines etc., is to be prevented. On the hanger 106, a pin or pivot 110 is swingably mounted in such a manner that a lever 108 can be swung at that portion (hereinafter referred to as a pivoted portion 109) near to the upper end thereof. A weight member 112 having a center of gravity at G is mounted on the lower end of the lever 108.

On a floor 114 (including the ground, foundation of the structure 102, floor of a building per se, etc.) which is directly or indirectly subjected to vibration due to an earthquake etc., there is provided a substantially rigid, columnar holder 116 which is vibrated with the floor 114. A pair of parallel arms or links 118 horizontally extend in a plane perpendicular to the pin 110. The pair of arms 118 have one end connected through a pin 120 to the upper end (hereinafter referred to as a connecting portion 119) of the lever 108 and the other end connected through a pin 122 to a holding element 124 provided on the upper portion of the holder 116. The ratio of a distance a between the axis of the pin 110 and the axis of the pin 120 to a distance b between the axis of the pin 110 and the center G of gravity of the weight member (hereinafter referred to as "a lever ratio") is preferably selected to have a greater value such as, for example, 1:30.

Suppose that, when the earthquake or vibration occurs, the floor 114 is absolutely displaced to an extent corresponding to $y$, in a direction indicated by arrow A in FIG. 1 and that the supported member 104 is absolutely displaced, to an extent corresponding to $x+y$, in a direction indicated by arrow B in FIG. 1. Then unless $x=0$, the supported member 104 is relatively displaced, according to the positive or negative value of $x$, right or left relative to the floor 114 to an extent corresponding to $|x|$. Since the top end of the lever 108 is connected through the arms 118 and holder 116 to the floor 114 and the pivotal portion 109 is connected through the hanger 106 to the supported member 104 by reason of the pin 120, the pivotal portion 109 is displaced, to an extent corresponding to $x$, relative to the top end of the lever 108 to cause the weight member 112 to be swung, together with the lever 108, about the pin 110. The swinging movement of the lever 108 (thus the weight member 112) causes an inertia force to be induced so that the supported member 104 is moved through the pivot 110 and hanger 106 in a direction opposite to that in which the supported member 104 is relatively moved. As a result, $x$ becomes small namely, the relative displacement between the floor 114 and the supported member 104 is reduced. Where the weight of the weight member 112 is identical, if the distance $a$ between the axis of the pin 110 and the axis of the pin 120 becomes smaller as the designing criteria and the rigidity of the equipment 100 permit, then the lever ratio $b/a$ becomes greater and the earthquake isolating and vibration absorbing effect will be enhanced by that extent.

Figure 3:
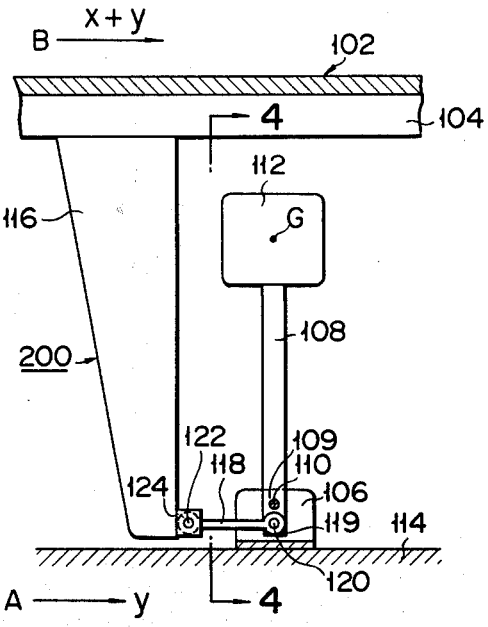
FIG. 3 is a front view, as taken along line 3—3 in FIG. 4, of an earthquake isolating and vibration absorbing equipment according to another embodiment of this invention.
Figure 4:
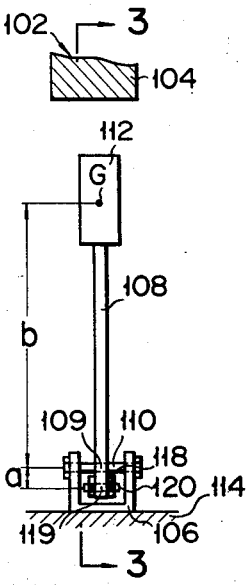
FIG. 4 is a view taken along line 4—4 in FIG. 3.

In an absorbing equipment 200 according to another embodiment shown in FIGS. 3 and 4, a hanger 106 is secured to a floor 114 and a substantially rigid holder 116 is fixed to the supported member 104 of a structure 102. In other words, this embodiment shows an inverted one of the absorbing equipment 100 shown in FIGS. 1 and 2.

As will be later explained, this embodiment can attain the same earthquake isolating and vibration absorbing effect as realized in the first embodiment.

Figure 5:
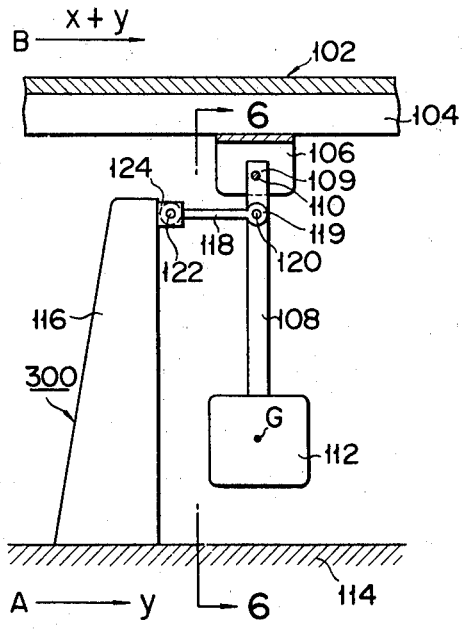
FIG. 5 is a front view, as taken along line 5—5 in FIG. 6, of an earthquake isolating and vibration absorbing equipment according to further embodiment of this invention.
Figure 6:
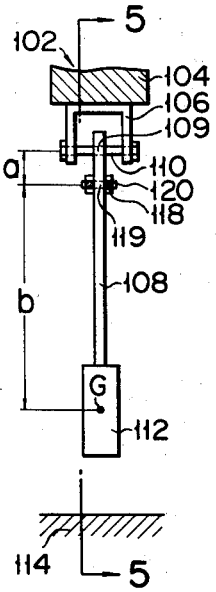
FIG. 6 is a view taken along line 6—6 in FIG. 5.
Figure 7:
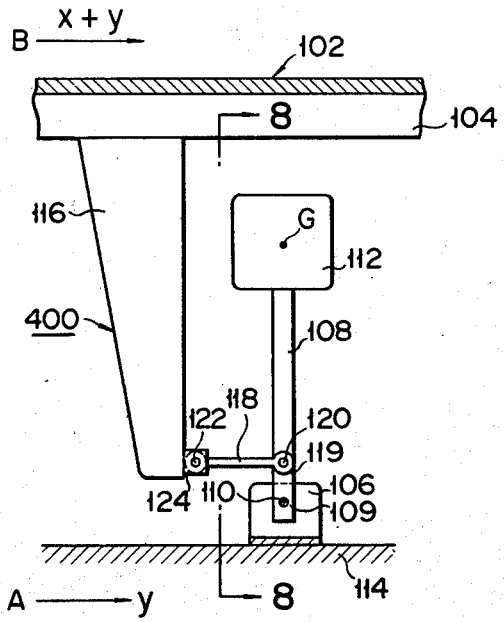
FIG. 7 is a front view, as taken along line 7—7 in FIG. 8, of an earthquake isolating and vibration absorbing equipment according to another embodiment of this invention.
Figure 8:
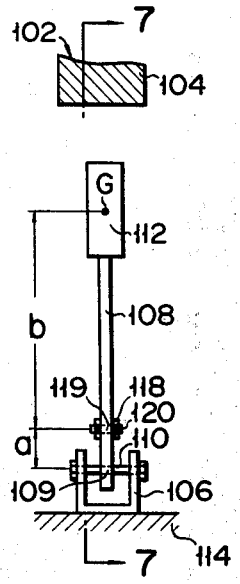
FIG. 8 is a view taken along line 8—8 in FIG. 7.

An absorbing equipment 300 shown in FIGS. 5 and 6 is obtained by modifying the position of the pivotal portion 109 of the absorbing equipment 100 shown in FIGS. 1 and 2, while an absorbing equipment 400 shown in FIGS. 7 and 8 is obtained by modifying the position of the pivotal portion 109 of the absorbing equipment 200 shown in FIGS. 3 and 4. In the embodiments shown in FIGS. 1 to 4, the weight member 112 and the connecting portion 119 are mounted on one end of the lever 108 and on the other end thereof, while, in the embodiments shown in FIGS. 5 to 8, a hanger 106 of FIGS. 5 and 6 is pivoted to the upper end of the lever 108 and a hanger 106 of FIGS. 7 and 8 is pivoted to the lower end of the lever 108 and a respective connecting portion 119 of the respective embodiment are located between a weight member 112 and a pivotal portion 109, i.e., the weight member 112 and the connecting portion 114 are located on the same side when viewed from the position of the pivoted portion 109. A lever ratio corresponding to that of FIGS. 1 to 4 is a ratio of a distance $a$ between a pin 110 and a pin 120 to a distance $b$ between the pin 120 and the center G of gravity of the weight member 112.

Figure 9:
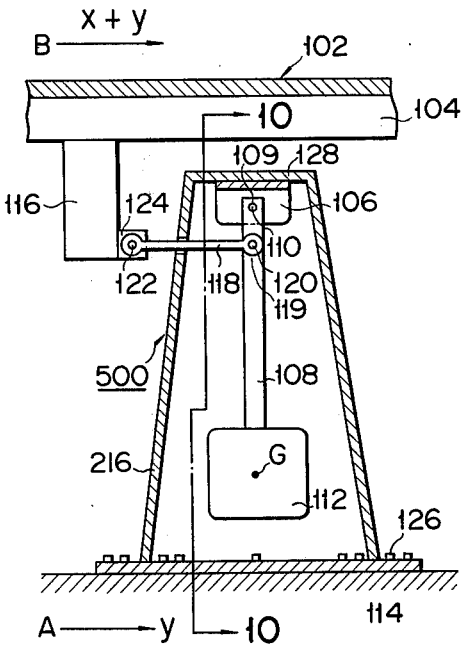
FIG. 9 is a front view, taken along line 9—9 in FIG. 10, of an earthquake isolating and vibration absorbing equipment according to another embodiment of this invention.
Figure 10:
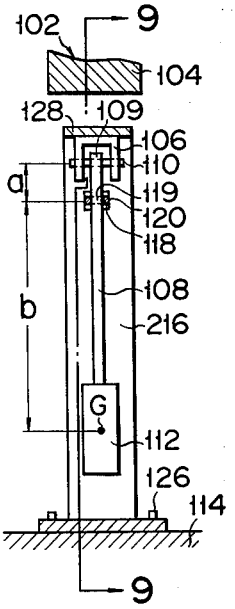
FIG. 10 is a view taken along line 10—10 in FIG. 9.

With an absorbing equipment 500 shown in FIGS. 9 and 10, a substantially rigid holder 116 is secured to a supported member 104 of a structure 102 and a substantially rigid, saddle type support 216 has a base portion secured by bolts 126 to a floor 114. A hanger 106 is fixed on an undersurface 128 of the top portion of the support 216. The arrangement of the other parts or members is similar to that shown in FIGS. 1 and 2. In this case, a lever ratio is the same as in the case of the embodiment shown in FIG. 6.

Figure 11:
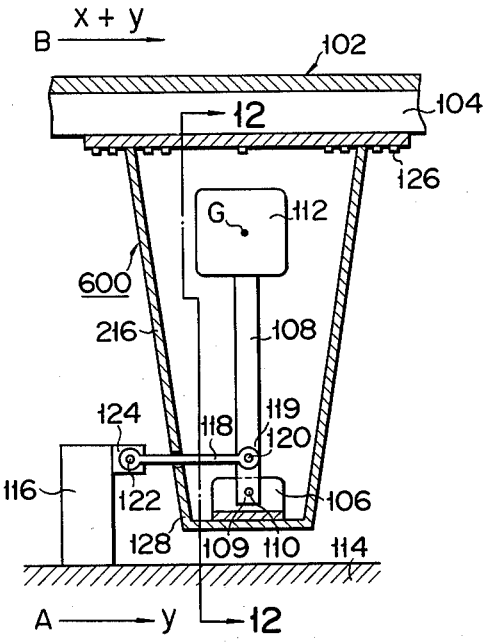
FIG. 11 is a front view, as taken along line 11—11 in FIG. 12, of an earthquake isolating and vibration absorbing equipment according to another embodiment of this invention.
Figure 12:
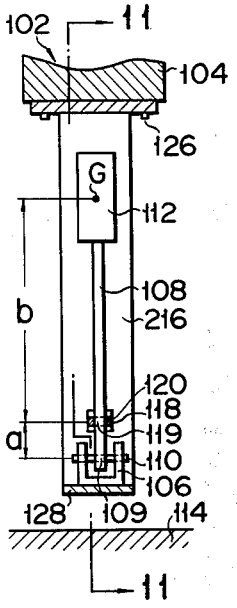
FIG. 12 is a view taken along line 12—12 in FIG. 11.
Figure 13:
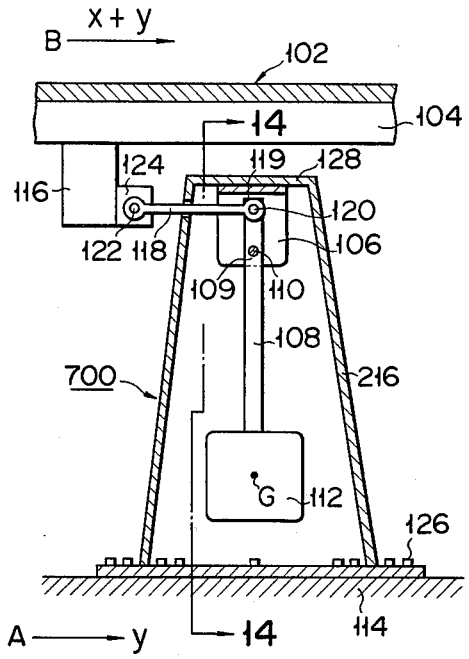
FIG. 13 is a front view, as taken along line 13—13 in FIG. 14, of an earthquake isolating and vibration absorbing equipment according to another embodiment of this invention.
Figure 14:
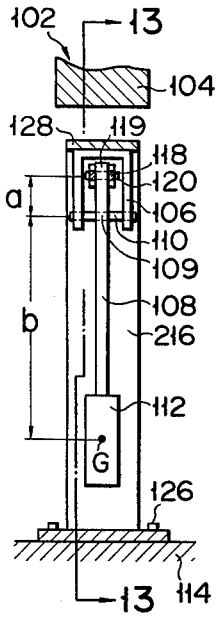
FIG. 14 is a view taken along line 14—14 in FIG. 13.
Figure 15:
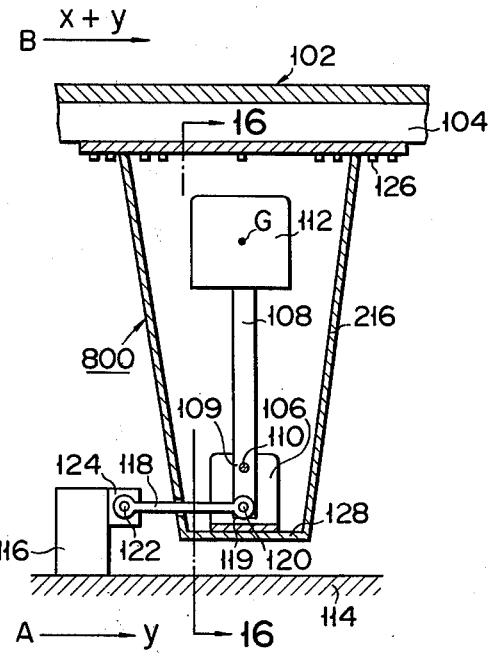
FIG. 15 is a front view, as taken along line 15—15 in FIG. 16, of an earthquake isolating and vibration absorbing equipment according to another embodiment of this invention.
Figure 16:
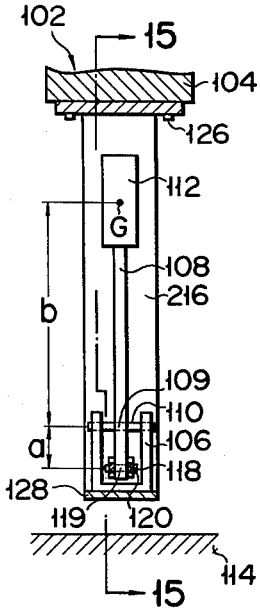
FIG. 16 is a view taken along line 16—16 in FIG. 15.
Figure 17:
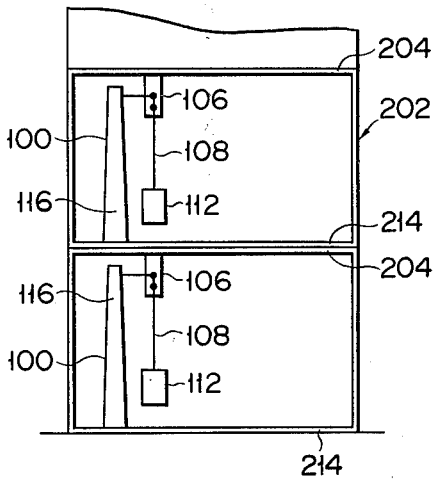
FIGS. 17 to 24 are schematic views showing multistory structures in which the earthquake isolating and vibration absorbing equipments showning in FIGS. 1, 3, 5, 7, 9, 11, 13 and 15 are installed, respectively.
Figure 18:
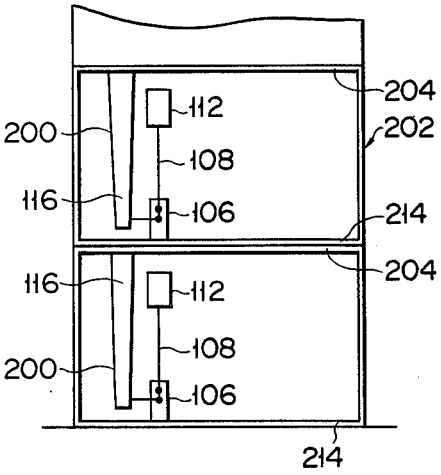
Figure 19:
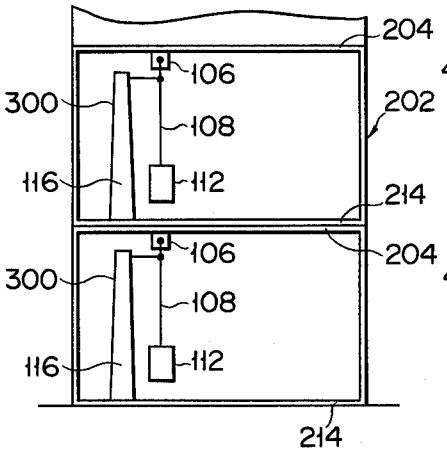
Figure 20:
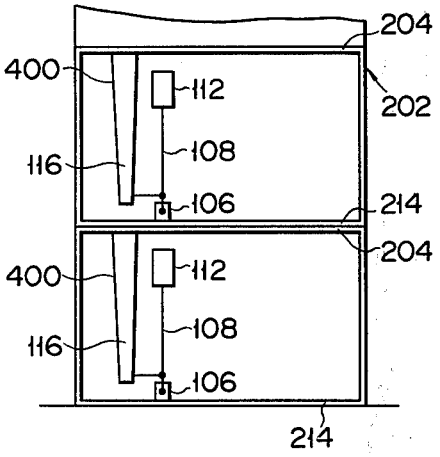
Figure 21:
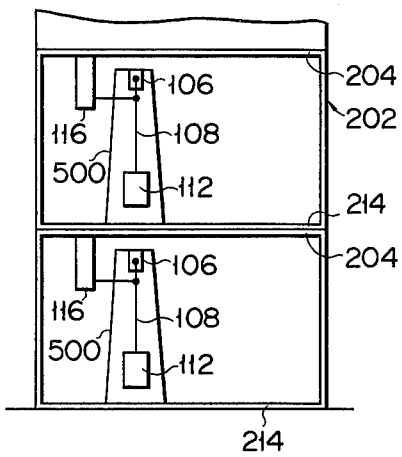
Figure 22:
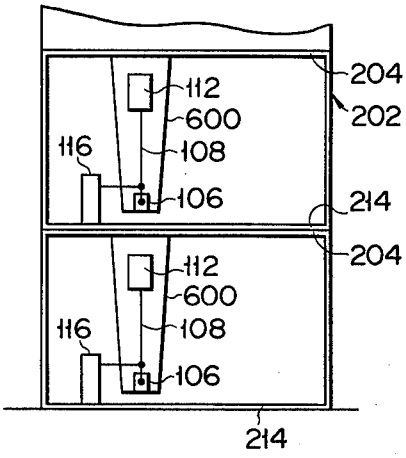
Figure 23:
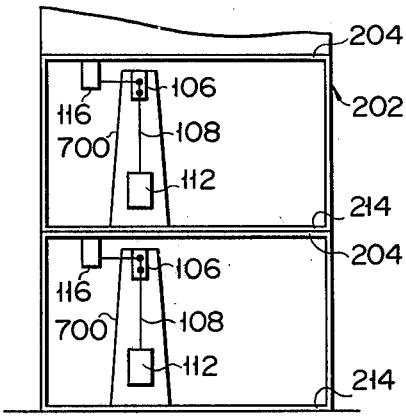
Figure 24:
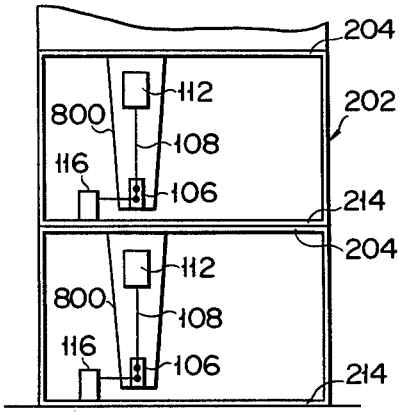

In an absorbing equipment 600 shown in FIGS. 11 and 12, a substantially rigid holder 116 is secured to a floor 114 and a substantially rigid, saddle type support 216 is secured to a supported member 104 of a structure 102. This arrangement shows an inverted form of the embodiment of FIGS. 9 and 10. A lever ratio is the same as in the case of the embodiment of FIG. 8.

In absorbing equipments 700 and 800, respectively, shown in FIGS. 13 and 14 and 15 and 16, a connecting portion 119 and weight member 112 are mounted on one end of a lever 108 and on the other end thereof with pivoting portion 109 disposed therebetween. These embodiments 700 and 800 of FIGS. 13 and 14 and 15 and 16 are similar in arrangement to the embodiments of FIGS. 9 and 10 and FIGS. 11 and 12, respectively, except that, in the latter embodiments, a connecting portion 119 is located between a pivoting portion 109 and a weight member 112. In these embodiments, a lever ratio is the same as in the embodiments shown in FIGS. 2 and 4, respectively.

FIGS. 17 to 24 show the cases in which the absorbing equipments 100, 200, 300, 400, 500, 600, 700 and 800 shown in FIGS. 1, 3, 5, 7, 9, 11, 13 and 15, respectively, are each installed in each floor of multistory building 202 which is one of the above-mentioned structures. In these cases, the floor means each floor 214 of the building 202 and the supported member means each ceiling 204 of the building 202. It will be understood that the installation of the absorbing equipment in each floor of the building permits the vibration or quake of the floor as caused by earthquake etc. to be reduced.

FIGS. 29 to 36 are views for explaining an earthquake isolating and vibration absorbing effect obtained from the arrangements of FIGS. 17 to 24. Now suppose that the whole weight of the structure is so concentrated on the first ceiling that the multi-story structure 202 can be regarded as a one-story building. Symbols hereinafter employed for explanation are defined as follows:

| | |
|---|---|
| $W_{11}$ | the whole weight of the structure 202; |
| $w_{12}$ | the weight of the weight member 112; |
| $k_{11}$ | the spring constant of columns of the structure 202; |
| x | a relative horizontal displacement of the ceiling 204 relative to the floor 214; |
| a | a distance between the axis of the pin 110 and the axis of the pin 120; |
| b | a distance from the center G of gravity of the weight member 112 to that pin mounted on the lever 108, which is closest to the center G of gravity of the weight member 112; |
| g | the acceleration of gravity; |
| $\ddot{x}$ | a horizontal acceleration of the ceiling 204 relative to the floor 214 of the building 202; |
| $\ddot{y}$ | the horizontal acceleration of the floor 214. |

Where no absorbing equipment is employed in the building 202, the equation of motion of the ceiling 204 can be expressed as follows:

$$\ddot{x} + k_{11}/w_{11}\, qx = -\ddot{y} \qquad 1$$

The natural frequency of the building 202 will be $$f_{10} = \frac{1}{2\pi}\sqrt{\frac{k_{11}}{w_{11}}g} \qquad (2)$$

Where the absorbing equipment according to this invention is installed as schematically shown in FIGS. 17 to 24 the operation of which is shown in FIGS. 29 to 36, the following equations will be given.

Figure 29:
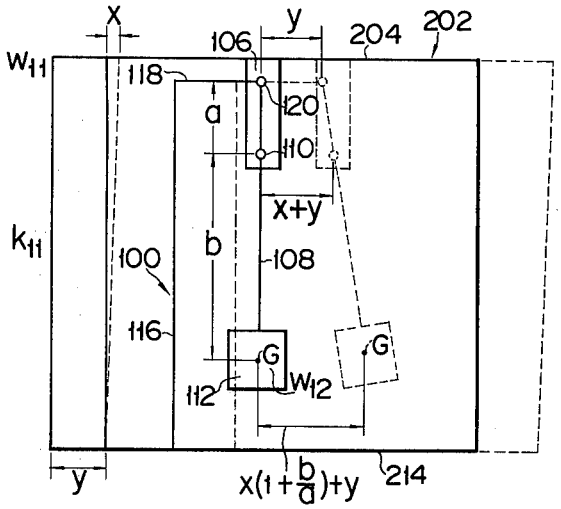
FIGS. 29 to 36 are schematic diagrams for explaining the operation of the earthquake isolating and vibration absorbing equipments as installed in the buildings shown in FIGS. 17 to 24.

With respect to the embodiment of FIG. 29, when $$M_{11} = \frac{w_{11}}{g} + \frac{w_{12}}{g}\left(1 + \frac{b}{a}\right)^2,$$

$$\overline{M}_{11} = \frac{w_{11}}{g} + \frac{w_{12}}{g}\left(1 + \frac{b}{a}\right) \text{ and}$$

-continued $$K_{11} = k_{11} + \frac{w_{12}b}{a^2},$$

the equation of motion of the ceiling 204 of the building 202 can be given below:

$$\ddot{x} + \frac{K_{11}}{M_{11}}x = -\frac{\overline{M}_{11}}{M_{11}}\ddot{y} \qquad (3)$$

Figure 30:
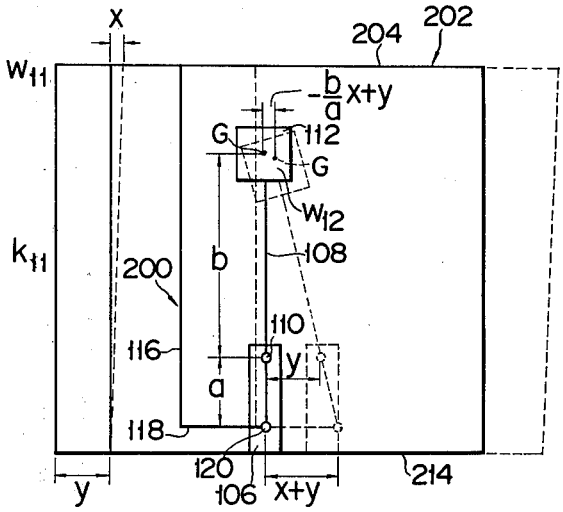

With respect to the embodiment of FIG. 30, when $$M_{12} = \frac{w_{11}}{g} + \frac{w_{12}}{g}\left(\frac{b}{a}\right)^2,$$

$$\overline{M}_{12} = \frac{w_{11}}{g} - \frac{w_{12}}{g}\left(\frac{b}{a}\right) \text{ and}$$

$$K_{12} = k_{11} - \frac{w_{12}b}{a^2},$$

the equation of motion of the ceiling 204 can be expressed as follows:

$$\ddot{x} + \frac{K_{12}}{M_{12}}x = -\frac{\overline{M}_{12}}{M_{12}}\ddot{y} \qquad (4)$$

Figure 31:
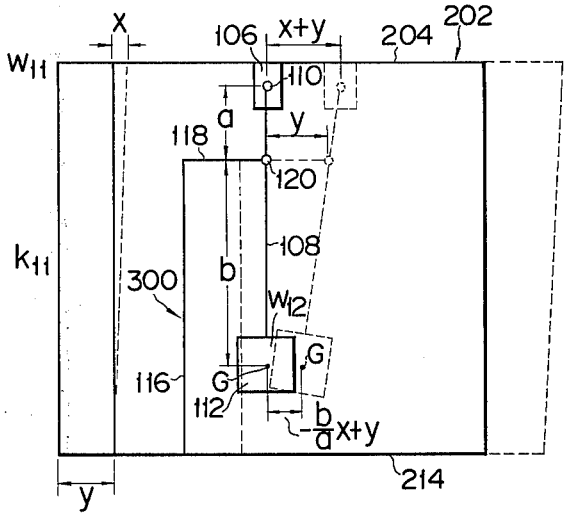

With respect to the embodiment of FIG. 31, when $$M_{13} = \frac{w_{11}}{g} + \frac{w_{12}}{g}\left(\frac{b}{a}\right)^2,$$

$$\overline{M}_{13} = \frac{w_{11}}{g} - \frac{w_{12}}{g}\frac{b}{a} \text{ and}$$

$$K_{13} = K_{11} + \frac{w_{12}}{a}\left(1 + \frac{b}{a}\right),$$

the equation of motion of the ceiling 204 can be expressed as follows:

$$\ddot{x} + \frac{K_{13}}{M_{13}}x = -\frac{\overline{M}_{13}}{M_{13}}\ddot{y} \qquad (5)$$

Figure 32:
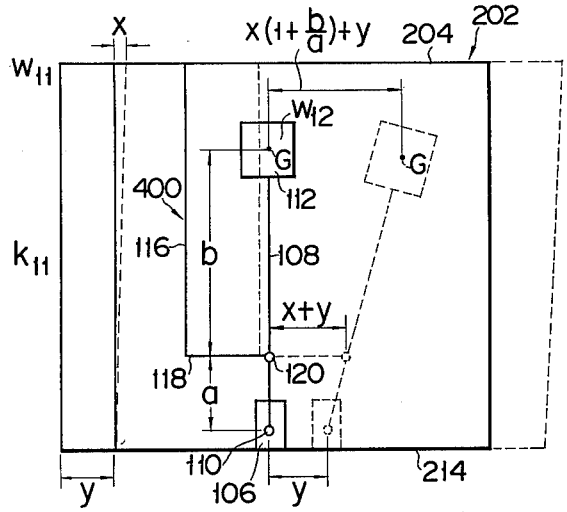

With respect to the embodiment of FIG. 32, when $$M_{14} = \frac{w_{11}}{g} + \frac{w_{12}}{g}\left(1 + \frac{b}{a}\right)^2,$$

$$\overline{M}_{14} = \frac{w_{11}}{g} + \frac{w_{12}}{g}\left(1 + \frac{b}{a}\right) \text{ and}$$

$$K_{14} = k_{11} - \frac{w_{12}}{a}\left(1 + \frac{b}{a}\right),$$

then the equation of motion of the ceiling 204 will be $$\ddot{x} + \frac{K_{14}}{M_{14}}x = -\frac{\overline{M}_{14}}{M_{14}}\ddot{y} \qquad (6)$$

Figure 33:
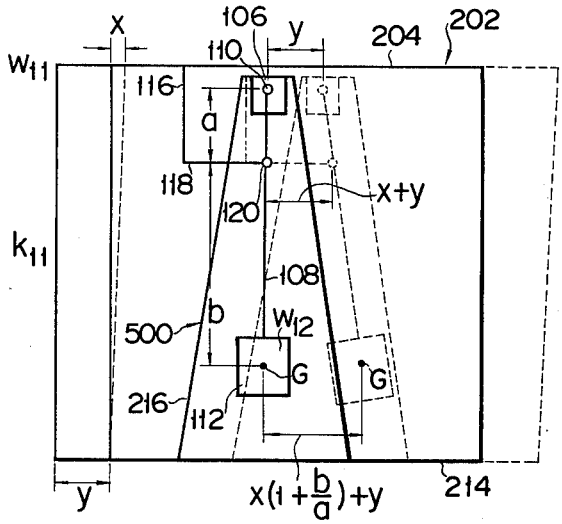

With respect to the embodiment of FIG. 33, when $$M_{14} = \frac{w_{11}}{g} + \frac{w_{12}}{g}\left(1 + \frac{b}{a}\right)^2,$$

$$\overline{M}_{15} = \frac{w_{11}}{g} + \frac{w_{12}}{g}\left(1 + \frac{b}{a}\right) \text{ and}$$

$$K_{15} = k_{11} + \frac{w_{12}}{a}\left(1 + \frac{b}{a}\right),$$

the equation of motion of the ceiling 204 can be expressed as follows:

$$\ddot{x} + \frac{K_{15}}{M_{15}} x = -\frac{\overline{M}_{15}}{M_{15}} \ddot{y} \quad (7)$$

Figure 34:
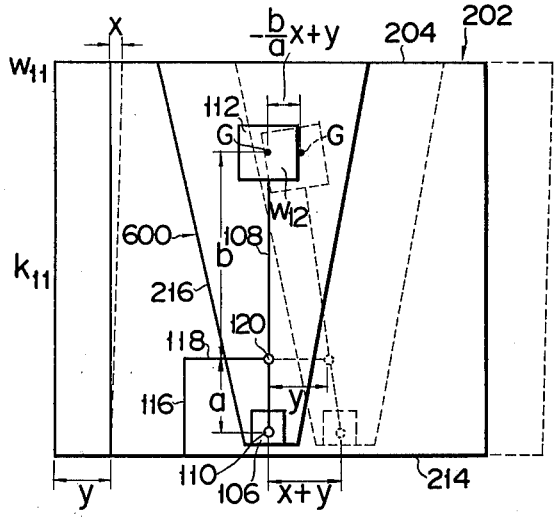

With respect to the embodiment of FIG. 34, when $$M_{16} = \frac{w_{11}}{g} + \frac{w_{12}}{g} \left(\frac{b}{a}\right)^2$$

$$\overline{M}_{16} = \frac{w_{11}}{g} - \frac{w_{12}}{g} \left(\frac{b}{a}\right) \text{ and}$$

$$K_{16} = k_{11} - \frac{w_{12}}{a} \left(1 + \frac{b}{a}\right),$$

the equation of motion of the ceiling 204 can be expressed as follows:

$$\ddot{x} + \frac{K_{16}}{M_{16}} x = -\frac{\overline{M}_{16}}{M_{16}} \ddot{y} \quad (8)$$

Figure 35:
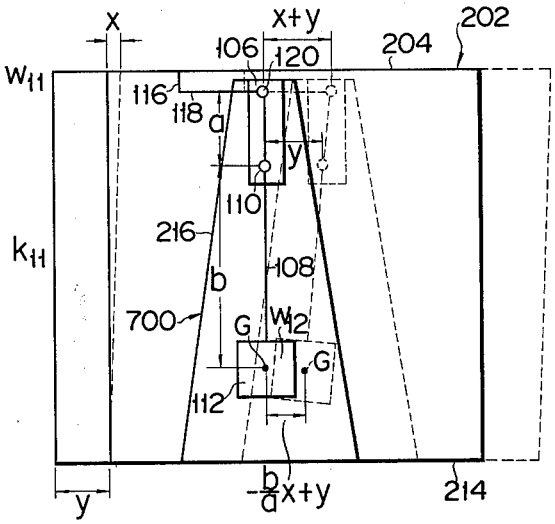

With respect to the embodiment of FIG. 35, when $$M_{17} = \frac{w_{11}}{g} + \frac{w_{12}}{g} \left(\frac{b}{a}\right)^2,$$

$$\overline{M}_{17} = \frac{w_{11}}{g} - \frac{w_{12}}{g} \cdot \frac{b}{a} \text{ and}$$

$$K_{17} = k_{11} + \frac{w_{12} b}{a^2},$$

the equation of motion of the ceiling 204 can be expressed as follows:

$$\ddot{x} + \frac{K_{17}}{M_{17}} x = -\frac{\overline{M}_{17}}{M_{17}} \ddot{y} \quad (9)$$

Figure 36:
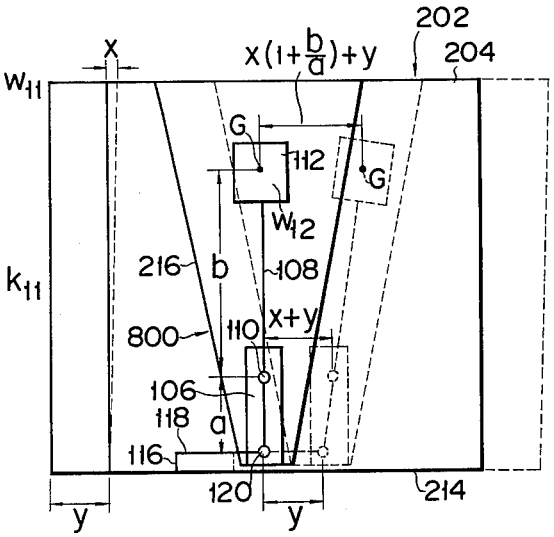

With respect to the embodiment of FIG. 36, when $$M_{18} = \frac{w_{11}}{g} + \frac{w_{12}}{g} \left(1 + \frac{b}{a}\right)^2,$$

$$\overline{M}_{18} = \frac{w_{11}}{g} + \frac{w_{12}}{g} \left(1 + \frac{b}{a}\right) \text{ and}$$

$$K_{18} = k_{11} - \frac{w_{12} b}{a^2},$$

the equation of motion of the ceiling 204 can be expressed as follows:

$$\ddot{x} + \frac{K_{18}}{M_{18}} x = -\frac{\overline{M}_{18}}{M_{18}} \ddot{y} \quad (10)$$

The equations (2) to (10), upon comparison with the equation (1), indicate that when absorbing and isolating coefficients $$\frac{\overline{M}_{11}}{M_{11}}, \frac{\overline{M}_{12}}{M_{12}}, \frac{\overline{M}_{13}}{M_{13}}, \frac{\overline{M}_{14}}{M_{14}}, \frac{\overline{M}_{15}}{M_{15}}, \frac{\overline{M}_{16}}{M_{16}}, \frac{\overline{M}_{17}}{M_{17}} \text{ and } \frac{\overline{M}_{18}}{M_{18}}$$

are less than 1, an earthquake isolating and vibration absorbing function becomes effective.

Regarding the embodiments of FIGS. 29 to 36, the natural frequencies of the building 202 can be represented as follows:

$$f_{11} = \frac{1}{2\pi} \sqrt{\frac{K_{11}}{M_{11}}} \quad (11)$$

$$f_{12} = \frac{1}{2\pi} \sqrt{\frac{K_{12}}{M_{12}}} \quad (12)$$

$$f_{13} = \frac{1}{2\pi} \sqrt{\frac{K_{13}}{M_{13}}} \quad (13)$$

$$f_{14} = \frac{1}{2\pi} \sqrt{\frac{K_{14}}{M_{14}}} \quad (14)$$

$$f_{15} = \frac{1}{2\pi} \sqrt{\frac{K_{15}}{M_{15}}} \quad (15)$$

$$f_{16} = \frac{1}{2\pi} \sqrt{\frac{K_{16}}{M_{16}}} \quad (16)$$

$$f_{17} = \frac{1}{2\pi} \sqrt{\frac{K_{17}}{M_{17}}} \quad (17)$$

$$f_{18} = \frac{1}{2\pi} \sqrt{\frac{K_{18}}{M_{18}}} \quad (18)$$

Where no absorbing equipment is used and where the absorbing equipment of this invention is employed as shown in FIGS. 29 to 36, if $w_{11}$, $w_{12}$, $a$ and $b$ are given by $w_{11} = 100$ tons
$w_{12} = 0.1$ ton
$a = 6$ cm
$b = 180$ cm, the absorbing and isolating factors and natural frequencies of the building 202 can be expressed as shown in Table 1, provided that the damping ratio is disregarded in either case.

Table 1

| | absorbing and isolating coefficients | absoring and isolating factors | natural frequencies of building |
|---|---|---|---|
| Fig. 29 | $\frac{\overline{M}_{11}}{M_{11}} = 0.526$ | 47.4% | $f_{11} = 1.96$ Hz |
| Fig. 30 | $\frac{\overline{M}_{12}}{M_{12}} = 0.511$ | 48.9% | $f_{12} = 1.96$ Hz |
| Fig. 31 | $\frac{\overline{M}_{13}}{M_{13}} = 0.511$ | 48.9% | $f_{13} = 2.00$ Hz |
| Fig. 32 | $\frac{\overline{M}_{14}}{M_{14}} = 0.526$ | 47.4% | $f_{14} = 1.93$ Hz |
| Fig. 33 | $\frac{\overline{M}_{15}}{M_{15}} = 0.526$ | 47.4% | $f_{15} = 1.97$ Hz |
| Fig. 34 | $\frac{\overline{M}_{16}}{M_{16}} = 0.511$ | 48.9% | $f_{16} = 1.96$ Hz |
| Fig. 35 | $\frac{\overline{M}_{17}}{M_{17}} = 0.511$ | 48.9% | $f_{17} = 2.00$ Hz |
| Fig. 36 | $\frac{\overline{M}_{18}}{M_{18}} = 0.526$ | 47.4% | $f_{18} = 1.93$ Hz |

Table 1-continued

| | absorbing and isolating coefficients | absoring and isolating factors | natural frequencies of building |
|---|---|---|---|
| No absorbing equipment employed | 1.000 | 0.0% | $f_{10} = 2.73$ Hz |

From this table, it will be understood that according to this invention, vibration can be reduced to substantially one half the original magnitude. It is also understood from this table that the natural frequency of the building is smaller than the case in which no absorbing equipment is used. In other words, the natural period is lengthened.

FIGS. 41 to 48 corresponding to FIGS. 29 to 36 show, in a case of 10% attenuation, a relation between a resonance curve S when the absorbing equipment according to this invention is used and resonance T when no absorbing equipment is employed. In the graphical representation as shown in FIGS. 41 to 48, the natural frequency (Hz) is plotted as abscissa and the ratio of a relative maximum displacement (which is referred to as $x_{max}$ since it shows the maximum value of $x$) to an absolute maximum displacement $y$ of the floor 214 of the building 202 due to vibration, i.e., a deflection amplitude ratio, is plotted as ordinate. In any case, according to this invention, vibration is restricted as compared with the case in which no absorbing equipment is employed. It is also observed that the natural frequency is varied.

Though explanation has been made in connection with the one-story building, it will be understood that, with respect to a multi-story building, an earthquake isolating and vibration absorbing effect can be obtained using the absorbing equipment according to this invention.

FIGS. 25 to 28 the case in which the absorbing equipment according to this invention is employed in a spherical tank structure 302 which is one example of the above-mentioned structure. In these figures, the spherical tank structure 302 comprises a spherical tank 304 and a supporting structure 306 supporting the spherical tank 304 and including a foundation 314, columns 308, braces 310 and girders 312 corresponding to the above-mentioned support member 104. In these cases, the ground or foundation 314 corresponds to the abovementioned floor 114.

In the embodiments shown in FIGS. 25 to 28, the absorbing equipments 100, 300, 500 and 700 shown in FIGS. 1, 5, 9 and 13, respectively, are employed.

Figure 25:
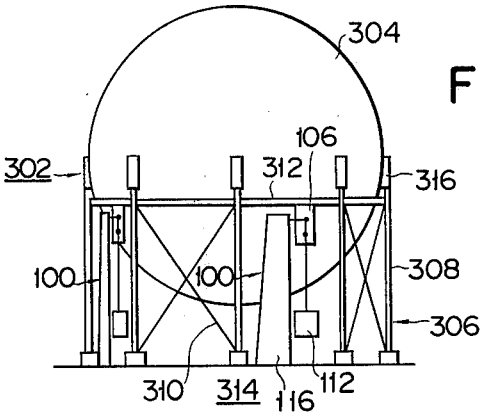
FIGS. 25 to 28 are schematic view showing structures, each comprised of a spherical tank and supporting structure, in which the earthquake isolating and vibration absorbing equipment shown in FIGS. 1, 5, 9 and 13 are installed, respectively.
Figure 26:
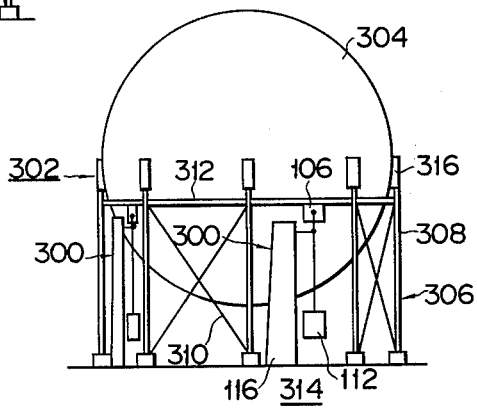
Figure 27:
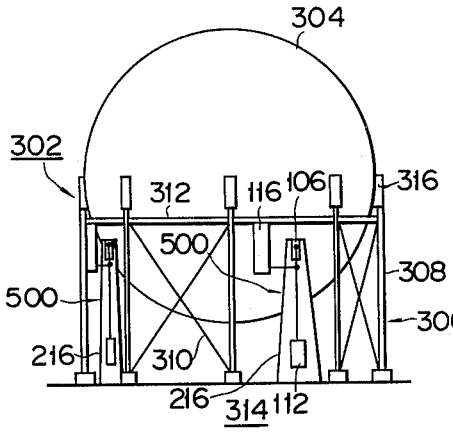
Figure 28:
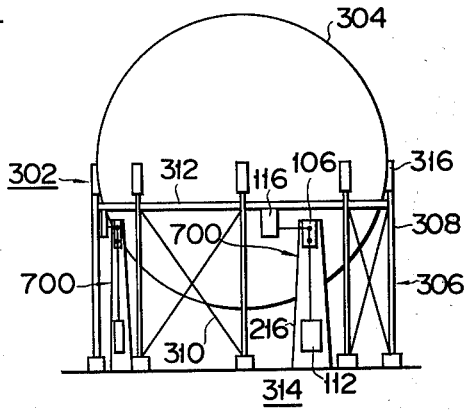

In FIGS. 25 and 26, the hangers 106 of the absorbing equipments 100 and 300 are fixed to the corresponding girders 312, respectively, and the holder 116 stands upright on the ground or the foundation 314. In FIGS. 27 and 28, the holders 116 of the absorbing equipments 500 and 700 are fixed to the corresponding girders 312, respectively, and the hanger 106 is secured to the top of a support 216 which stands upright on the ground or foundation 314.

FIGS. 37 to 40 are views for explaining an earthquake isolating and vibration absorbing effect as obtained from the embodiments shown in FIGS. 25 to 28. Let symbols employed throughout these figures be defined as follows:

| | |
|---|---|
| $w_1$ | the weight of the spherical tank 304 |
| $w_2$ | the weight of the weight member 112 |
| $k_1$ | the spring constant of the supporting structure 306 as involved between the girder 312 and the ground or foundation 314 |
| $k_2$ | the spring constant of the supporting structure 306 as involved between the girder 312 and the connection 316 of the column 308 to the tank 304 |
| a | a distance between the axis of the pin 110 and the axis of the pin 120 |
| b | a distance from the center G of gravity of the weight member 112 to that pin mounted on the lever 108 which is closest to the center G of gravity of the weight member 112 |
| g | the acceleration of gravity |
| $x_1$ | the relative horizontal displacement of the girder 312 relative to the ground or the foundation 314 |
| $x_2$ | the relative horizontal displacement of the connection 316 relative to the ground or the foundation 314 |
| $\ddot{x}_1$ | the horizontal acceleration of the girder 312 |
| $\ddot{x}_2$ | the horizontal acceleration of the spherical tank 304 |
| $\ddot{y}$ | the horizontal acceleration of the ground or the foundation 314 |

Suppose that attenuation (or damping ratio) is not taken into consideration.

Where no absorbing equipment is used, the equation of motion of the spherical tank will be $$\ddot{x}_2 + \frac{g}{w_2} \cdot \frac{k_1 k_2}{k_1 + k_2} x_2 = -\ddot{y} \tag{19}$$

and the natural period can be expressed as follows:

$$T = 2\pi \sqrt{\frac{k_1 + k_2}{k_1 k_2} \cdot \frac{w_2}{g}} \tag{20}$$

In contrast, where the absorbing equipment according to this invention is employed, the equation of motion of the spherical tank structure can be expressed as $$\begin{bmatrix} \frac{w_2}{g} & 0 \\ 0 & K_1 \end{bmatrix} \begin{Bmatrix} \ddot{x}_2 \\ \ddot{x}_1 \end{Bmatrix} + \begin{bmatrix} k_2 & -k_2 \\ -k_2 & K_2 \end{bmatrix} \begin{Bmatrix} x_2 \\ x_1 \end{Bmatrix} = -\begin{Bmatrix} \frac{w_2}{g} \\ K_3 \end{Bmatrix} \ddot{y} \tag{21}$$

in which $K_1$, $K_2$ and $K_3$ are given as shown in Table 2.

Table 2

| Fig. No. | $K_1$ | $K_2$ | $K_3$ |
|---|---|---|---|
| Fig. 25 (Fig. 37) | $\frac{w_2}{g}\left(2+\frac{2b}{a}+\frac{b^2}{a^2}\right)$ | $k_1+k_2+\frac{w_2}{a}\left(\frac{b}{a}\right)$ | $\frac{w_2}{g}\left(2+\frac{b}{a}\right)$ |
| Fig. 26 (Fig. 38) | $\frac{w_2}{g}\left(1+\frac{b^2}{a^2}\right)$ | $k_1+k_2+\frac{w_2}{a}\left(1+\frac{b}{a}\right)$ | $\frac{w_2}{g}\left(1-\frac{b}{a}\right)$ |
| Fig. 27 (Fig. 39) | $\frac{w_2}{g}\left(1+\frac{b}{a}\right)^2$ | $k_1+k_2+\frac{w_2}{a}\left(1+\frac{b}{a}\right)$ | $\frac{w_2}{g}\left(1+\frac{b}{a}\right)$ |

Table 2-continued

| Fig. No. | $K_1$ | $K_2$ | $K_3$ |
|---|---|---|---|
| Fig. 28 (Fig. 40) | $\frac{w_2}{g}\left(\frac{b}{a}\right)^2$ | $k_1+k_2+\frac{w_2}{a}\left(\frac{b}{a}\right)$ | $\frac{w_2}{g}\left(\frac{b}{a}\right)$ |

A symbol "$s$" appearing in the following explanation denotes 1, 2.

With $q_s$ representing the time function, a modular analysis technique shows $$\{x\} = \{X_1\ q_1 + \{X_2\}q_2$$

provided that $$\{X_s\} = \left\{\begin{matrix} X_{1s} \\ X_{2s} \end{matrix}\right\}.$$

If an attenuation of $h_s$ is given with respect to the time function $q_s$ in modular analysis, then the equation of motion of the spherical tank structure 302 can be expressed as follows:

$$\ddot{q}s + 2\ h_s \sqrt{\frac{K_s}{M_s}}\ \dot{q}s + \frac{K_s}{M_s}\ qs = -\frac{\overline{M}_s}{M_s}\ddot{y} \qquad (22)$$

With $\beta s$ representing $$\left|\frac{\overline{M}_s}{M_s}\right|$$

obtained when the absorbing equipment according to this invention is employed, and $\beta_1$ representing the value of the first degree of $\beta_s$ and with $\beta_0$ representing that value corresponding to $\beta_1$ which is obtained when no absorbing equipment is employed, if $\beta_1/\beta_0<1$, an earthquake isolating and vibration absorbing effect become effective.

Here, $$M_5 = \{X_s\}^T\ [m]\ \{X_s\};$$

$$K_s = \{X_s\}^T\ [k]\ \{X_s\};$$

$$M_s = \{X_s\}^T\ [\overline{m}];$$

where $[m]$ denotes mass matrices and is equal to $$\begin{bmatrix} \frac{W_2}{g} & 0 \\ 0 & K_1 \end{bmatrix}$$

appearing in the equation (21);

$[k]$ denotes stiffness matrices and is equal to $$\begin{bmatrix} k_2 & -k_2 \\ -k_2 & K_2 \end{bmatrix}$$

appearing in the equation 21); and $[\overline{m}]$ denotes vectors equal to $$\begin{Bmatrix} \frac{W_2}{g} \\ K_3 \end{Bmatrix}$$

appearing in the equation (21).

The natural period is represented by $$T_s = \pi\sqrt{\frac{M_s}{K_s}}$$

provided that $s = 1, 2$ corresponding to the natural periods of the first and second degrees.

In FIGS. 37 to 40 which show the operation of the absorbing equipments in FIGS. 25 to 28, when $W_1 = 500$ tons,
$w_2 = 0.5$ ton,
$a = 10$ cm,
$b = 400$ cm,
$k_1 = 180$ tons/cm and
$k_2 = 360$ tons/cm, then, the natural frequency $\beta_1/\beta_0$ and absorbing and isolating factors can be represented as shown in Table 3.

Table 3

Figure 38:
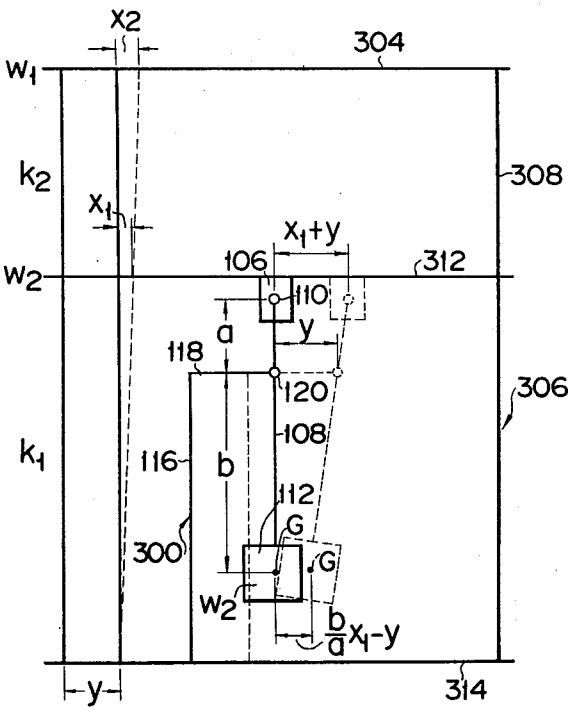
FIGS. 37 to 40 are schematic diagrams for explaining the operation of the earthquake isolating and vibration absorbing equipments as installed in the spherical tank structures shown in FIGS. 25 to 28.
Figure 37:
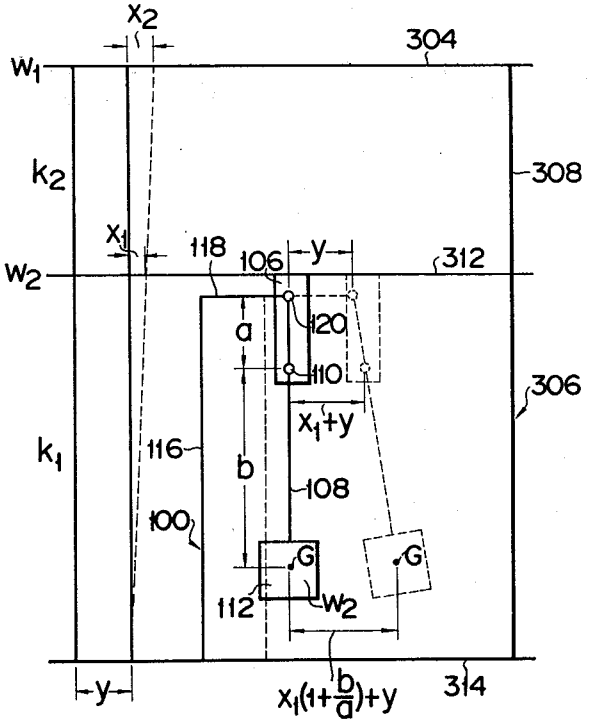
Figure 40:
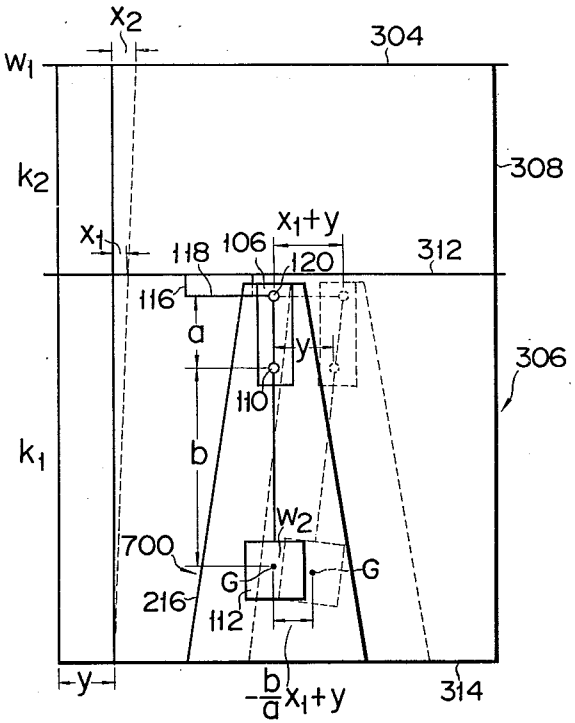
Figure 39:
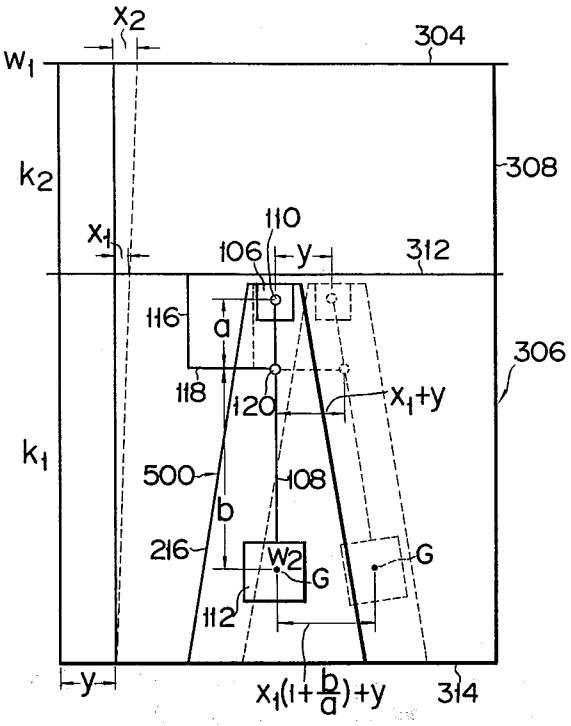
Figure 41:
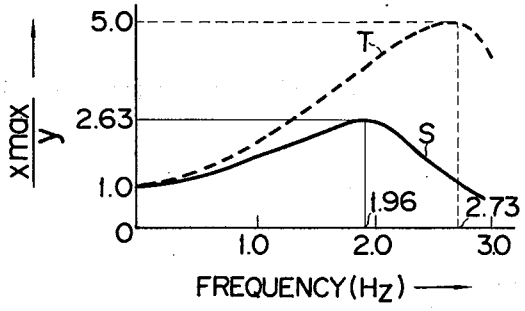
FIGS. 41 to 48 are graphical representations showing different vibration absorbing characteristics observed between the case where the earthquake isolating and vibration absorbing equipments according to this invention to be used with the structures as shown in FIGS. 29 to 36 are employed and the case where no such equipment is employed.
Figure 42:
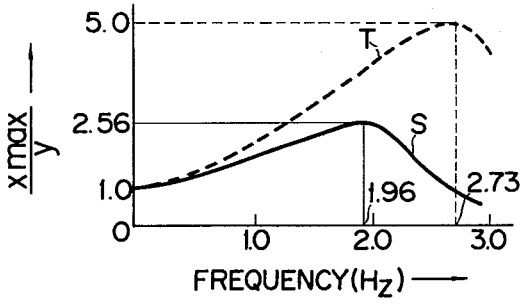
Figure 43:
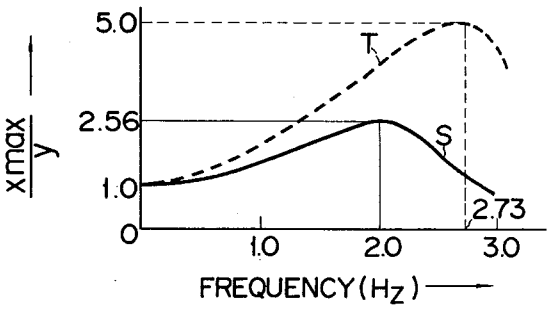
Figure 44:
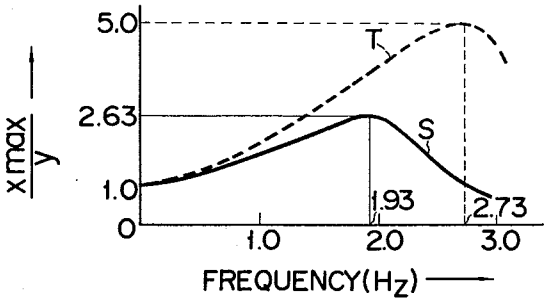
Figure 45:
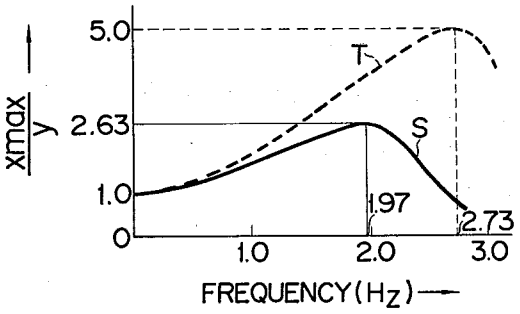
Figure 46:
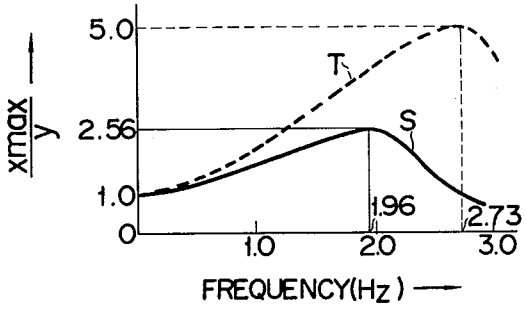
Figure 47:
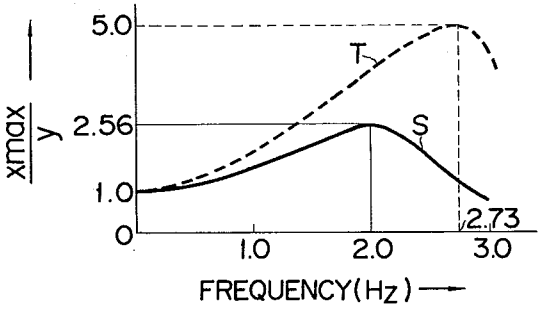
Figure 48:
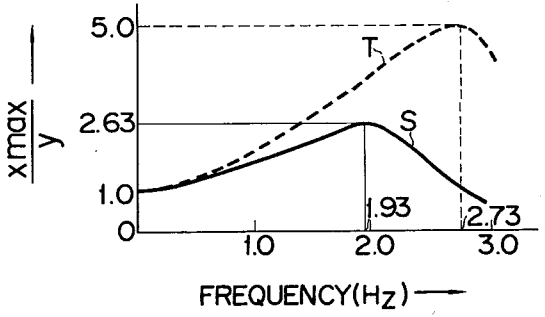

| | natural periods | $\beta_1/\beta_0$ | absorbing and isolating factors |
|---|---|---|---|
| No absorbing equipment employed | 0.41 sec. | 1.000 | 0.0% |
| Fig. 37 | $T_1$ = 0.566 sec. | 0.597 | 40.3% |
| Fig. 38 | $T_1$= 0.564 sec. | 0.573 | 42.7% |
| Fig. 39 | $T_1$= 0.566 sec. | 0.597 | 40.3% |
| Fig. 40 | $T_1$= 0.564 sec. | 0.573 | 42.7% |

As a result of actual measurement, spherical tank structures in general have a natural period of 0.3 to 0.5 sec. This natural period is within the earthquake acceleration resonance range of strong earthquakes heretofore encountered.

Assume that the acceleration of the ground surface be 0.3 $g$ ($g$= 980 cm/sec$^2$), a value approximate to the acceleration of the strongest earthquake which has been experienced. Since the damping of general spherical tank structures is less than that of buildings, the response acceleration of the tank structures in response to the acceleration of the ground surface is amplified to 0.6 to 1.0 $g$. In order to withstand such response acceleration, the static seismic intensity $k$ of design the criteria is required to fall within the range of 0.6 to 1.0. In this case, the conventional tank structure requires a very extensive reinforcement, with the consequent impracticability. Usually, $k$ is selected, as the static seismic intensity of design criteria, to have a value of 0.2 to 0.3. If $k$ is so selected, it will be evident that the tank structure can not withstand possible strong earthquakes, since a greater response acceleration is involved due to the fact that the natural frequency lies in the region of an acceleration resonance.

Where the absorbing equipment according to this invention is applied to the spherical tank structure, even if the weight ratio of the spherical tank to the weight member is about 1000:1, the natural period of the sperical tank structure can be so shifted, as shown in Table 3, that it falls outside the range of the acceleration resonance of possible strong earthquakes. Furthermore, it is possible to reduce the acceleration response of the tank structure by more than 40%. These facts, together with the fact that the viscous damping of the spherical tank structure is increased by the swing of the weight member, causes the tank structure to less respond to the earthquake. Suppose that the tank structure is designed at $k = 0.3$ and even if, in this case, the ground surface is quaked at the acceleration of $0.3g$, the response acceleration of the tank structure using the absorbing equipment of this invention is not increased to any greater extent. Since, therefore, the tank structure has a strength well within the allowable stress range, the tank structure to which the absorbing equipment according to this invention is applied can fully withstand possible strong earthquakes.

Moreover, the hanger 106 or the holder 116 can be mounted in the corresponding position by making only a slight modification and change to the columns or the foundation.

Though, in FIGS. 17 to 40, the lever ratio, i.e., the ratio of the distance a between the axis of the pin 110 and the axis of the pin 120 to the distance *b* between the pin 110 or 120 and the center G of gravity of the weight member 112 has been described as being 1:30, the lever ratio is not restricted thereto and it may take any value near to 1:30. By such lever ratio, the weight of the weight member of the absorbing equipment can be made equal to, or near to, one-thousandth the weight of the structure including the building and spherical tank and, therefore, it is possible to shift the natural period of the structure beyond the resonance period of vibration or quake due to earthquakes etc. even if the absorbing equipment is made small-sized.

A suitable selection of a lever ratio $b/a$ assures a sufficient earthquake isolating and vibration absorbing effect, even if the weight of the weight member of the absorbing equipment is made, for example, 1/300th to 1/3000th the weight of the structure.

What we claim is:

1. An earthquake isolating and vibration absorbing equipment for structures which each is provided with a floor member and a supported member carried by the floor member, said equipment including a hanger connected to one of the members, a lever normally positioned vertically and pivoted to the hanger at a pivotal point in one end portion of the lever, a weight member mounted on the other end portion of the lever, a holder secured to the other of said members, an arm member having one end pivoted to a free end portion of the holder and the other end pivoted to a portion of the lever other than the pivotal point, said arm member extending horizontally so as to be parallel with the supported member and the floor member, and the weight member being adapted to swing to produce an inertia which applies to, and along the arm member through the lever, a force resisting against, and reducing the horizontal movement of the supported member resulting from an earthquake and for vibration of the floor member.

2. The earthquake isolating and vibration absorbing equipment for structures according to claim 1, in which that portion of said lever pivoted to the other end of the arm member is located, with respect to said pivotal point of the lever, on the side opposite to the side on which said weight member is disposed.

3. The earthquake isolating and vibration absorbing equipment according to claim 2, in which said holder is fixed to the floor member.

4. The earthquake isolating and vibration absorbing equipment according to claim 3, in which said holder is secured to the supported member.

5. The earthquake isolating and vibration absorbing equipment according to claim 3, in which there is further provided a support secured to, and suspended from, said supported member and having said hanger fixed on the undersurface of the free end thereof.

6. The earthquake isolating and vibration absorbing equipment according to claim 2 in which said holder is fixedly mounted on the supported member.

7. The earthquake isolating and vibration absorbing equipment according to claim 6, in which said hanger is secured to said floor member.

8. The earthquake isolating and vibration absorbing equipment according to claim 6, in which there is further provided a support secured upright to said floor member and having said hanger fixed on the undersurface of the top end thereof.

9. The earthquake isolating and vibration absorbing equipment according to claim 1, in which that portion of said lever pivoted to the other end of said arm member is located between the weight member and said pivotal point of said lever pivoted to the hanger.

10. The earthquake isolating and vibration absorbing equipment according to claim 9, in which said holder is fixedly mounted on said supported member.

11. The earthquake isolating and vibration absorbing equipment according to claim 10, in which said hanger is fixedly secured to said floor member.

12. The earthquake isolating and vibration absorbing equipment according to claim 10, further including a support fixedly secured to said floor member and having said hanger fixed on the undersurface of the top end thereof.

13. The earthquake isolating and vibration absorbing equipment according to claim 9, in which said holder is fixedly secured to said supported member.

14. The earthquake isolating and vibration absorbing equipment according to claim 13, in which said hanger is fixedly mounted to said floor member.

15. The earthquake isolating and vibration absorbing equipment according to claim 13 in which there is further provided a support fixedly mounted upright to said floor member and having said hanger fixed on the undersurface of the top end thereof.

16. The earthquake isolating and vibration absorbing equipment according to claim 1 in which said lever is pivoted through a pivot to said hanger, the other end of said arm member being pivoted through a pin to said one end portion of the lever, and the ratio of a distance between the axis of said pivot and the axis of said pin to a distance between the axis of said pivot and the center of gravity of said weight member being substantially 1:30 when the ratio of the weight of the weight member to the weight of the supported structure is substantially 1:300 to 1:3000.

* * * * *